US005759272A

United States Patent [19]

Lisec

[11] Patent Number: 5,759,272

[45] Date of Patent: Jun. 2, 1998

[54] MANUAL SEALING DEVICE

[76] Inventor: Peter Lisec, Bahnhofstrasse 34, A-3363 Amstetten-Hausmening (Niederösterreich), Austria

[21] Appl. No.: 611,954

[22] Filed: Mar. 6, 1996

[30] Foreign Application Priority Data

Mar. 17, 1995 [AT] Austria ..... 478/95

[51] Int. Cl.[6] ..... B05B 3/12; B05B 15/06; B05B 7/02; B05B 9/01

[52] U.S. Cl. ..... 118/323; 118/256; 239/525; 239/532

[58] Field of Search ..... 118/256, 323, 118/300, 263; 239/532, 525; 222/174; 52/208

[56] References Cited

U.S. PATENT DOCUMENTS

| | | | |
|---|---|---|---|
| 1,745,972 | 2/1930 | Beck | 239/532 |
| 5,485,960 | 1/1996 | Troudt | 239/532 |
| 5,535,791 | 7/1996 | Lisec | 141/113 |

FOREIGN PATENT DOCUMENTS

| | | | |
|---|---|---|---|
| 0 471 247 | 2/1992 | European Pat. Off. . | |
| 3 818 631 | 12/1989 | Germany . | |
| 40 33 403 | 2/1992 | Germany . | |
| 4 232 554 | 1/1994 | Germany . | |
| 94 07 507.7 | 10/1994 | Germany | 141/113 |
| 295 05 433 | 7/1995 | Germany . | |
| 19 505 771 | 9/1996 | Germany . | |

*Primary Examiner*—Donald E. Czaja
*Assistant Examiner*—Calvin Padgett
*Attorney, Agent, or Firm*—Young & Thompson

[57] ABSTRACT

A manual sealing unit consists of a crane-like bracket (1), which is mounted to rotate around a vertical axis (9). A boom (2) is connected to pivot around a vertical axis (12) and around a horizontal axis (15) at the free end (10) of a horizontal segment (11) of the bracket (1). Supply conduits (6, 7), by which the components of the sealing compound are conveyed to a mixing device (4) and a manual sealing nozzle (3) that is connected to the latter, are fastened to the bracket (1) and the boom (2). In the area of the joint between the bracket (1) and the boom (2), the conduits (6 and 7) are arranged in bends (21) and have a rotating joint (22) there, so that the movability of the boom (2) is not hampered. The boom (2) is loaded upward by a pneumatic cylinder (19), so that the combination of the mixing device (4) and the sealing nozzle (3) for an operator executing the manual sealing is virtually weightless.

9 Claims, 2 Drawing Sheets

MANUAL SEALING DEVICE

The invention relates to a device for filling the edge seams of insulating glass panes with sealing compound, with a sealing nozzle that is to be moved by hand along the edge seam, from which sealing compound is injected into the edge seam, and with a support for the sealing nozzle and the lines leading into it for the components of the sealing compound.

In addition to partially or fully automated devices for filling the edge seams of insulating glass panes with sealing compound ("sealing dispensers"), so-called "manual sealing units" are also known. In the case of these "manual sealing units," a sealing nozzle that is fed with sealing compound is moved by hand along the edge seam of an insulating glass pane. During the manual sealing, the insulating glass pane is usually held on a rotary table ("sealing table") and rotated at the speed at which the sealing is done, so that the individual who is performing the sealing does not have to move around the insulating glass pane.

During manual sealing, the individual who is performing the sealing must hold the sealing nozzle, on which a mixing device ("mixing trumpet") for mixing the two components (basic component and hardener) of the sealing compound is also usually mounted, and run it along the edge seam. Because of the weight of the sealing nozzle and the mixing device, this requires that a good deal of force be applied, and it can also be attributed to the weight of the lines through which the components of the sealing compound are fed to the sealing nozzle.

To reduce the burden, it has already been proposed that the sealing nozzle be suspended on a crane or the like via a spring-loaded rope roller.

The known suspensions for manual sealing nozzles are problematical to the extent that they limit the elbow room of the operator and allow work at only one sealing table.

The object of the invention is to indicate a device of the type mentioned above with which handling of the sealing nozzle with the largest possible operating range can be done with most of the weight removed from the operator.

This object is achieved according to the invention in that the support has a first bracket, which can be rotated around a basically vertical axis, and at the free end of said bracket a boom is provided which at its free end carries the sealing nozzle, that the boom can be pivoted both around a vertical axis and around a horizontal axis, and that the boom is loaded by upward force to allow pivoting of its free end.

With the device according to the invention, a considerable operating range is ensured since the bracket can pivot back and forth, for example, by 220° and the boom can pivot back and forth, for example, by 270°, so that with reasonable bracket and boom lengths (in each case a full 2 m), an operating range radius of, for example, 4.3 m can be achieved.

Because the boom is spring-loaded upward in the direction of a pivoting of its free end, the operator has a virtually weightless manual sealing nozzle including the corresponding mixing device.

The advantageous movability, according to the invention, of the support for the sealing nozzle is especially simply ensured if, according to a proposal of the invention, it is provided that a support is mounted at the free end of the bracket to pivot around the vertical axis, on which the boom is mounted to pivot around the horizontal axis.

A stable and compact design is produced when the support is U-shaped in cross section and its flange is arranged above the boom.

An especially simple and reliable design, in which the removal of the weight of the boom that is ensured according to the invention is reliably implemented, is achieved if to the boom an arm is rigidly fastened whose free end is spring-loaded upward to allow pivoting of the free end of the boom.

According to a proposal of the invention, it can be provided that the boom is loaded with force by a spring, especially a pneumatic cylinder. Thus the force with which the boom is loaded upward can be simply set to the value that is necessary in each case.

A design that is reliable and does not unnecessarily burden the components of the device according to the invention is produced if the spring is clamped between the free end of the arm and the support.

In an embodiment of the invention, it is provided that the arm projects upward through an opening that is provided in the flange of the support. This embodiment produces a compact design in the area of the articulation between the bracket and the boom.

To avoid hampering movability between boom and bracket, it can be provided according to a proposal of the invention that the lines for supplying the components of the sealing compound to the sealing nozzle or the mixing device that is placed upstream from it in the area of the hinged connection between bracket and boom is deflected upward in an arc. For the same purpose, it can be provided within the scope of the invention that in the area of the bends in the lines, a rotating joint is provided in each case.

In this case, an embodiment in which it is provided that the rotating joints in the segments of the bends of the lines that lead upward from the bracket has proven to be of value. This embodiment of the invention also helps to avoid hampering the movability of the boom and thus of the sealing nozzle.

A statically advantageous design is produced if the bracket and the boom are basically of the same length.

If, according to a proposal of the invention, it is provided that the sealing nozzle, including the device for mixing the two components of the sealing compound, is suspended exclusively via the lines on the free end of the boom, a simple design is provided, and, moreover, the handling of the sealing nozzle is not impeded by additional means by which said nozzle is fastened to the free end of the boom.

Finally, within the scope of the invention, it is also provided that on the free end of the boom, a switch is provided, whose actuation causes the pneumatic cylinder to be pressurized corresponding to the highest and/or lowest possible position of the free end of the boom. In this way, the sealing nozzle, including the mixing device, is raised into a resting position when it is not in use and is lowered when it is not to be used for an extended period in order to dip into, for example, a deep-cooling vessel.

Other details, features and advantages of the invention emerge from the description below of the embodiment of the invention shown in the drawings. Here:

Figure 1:
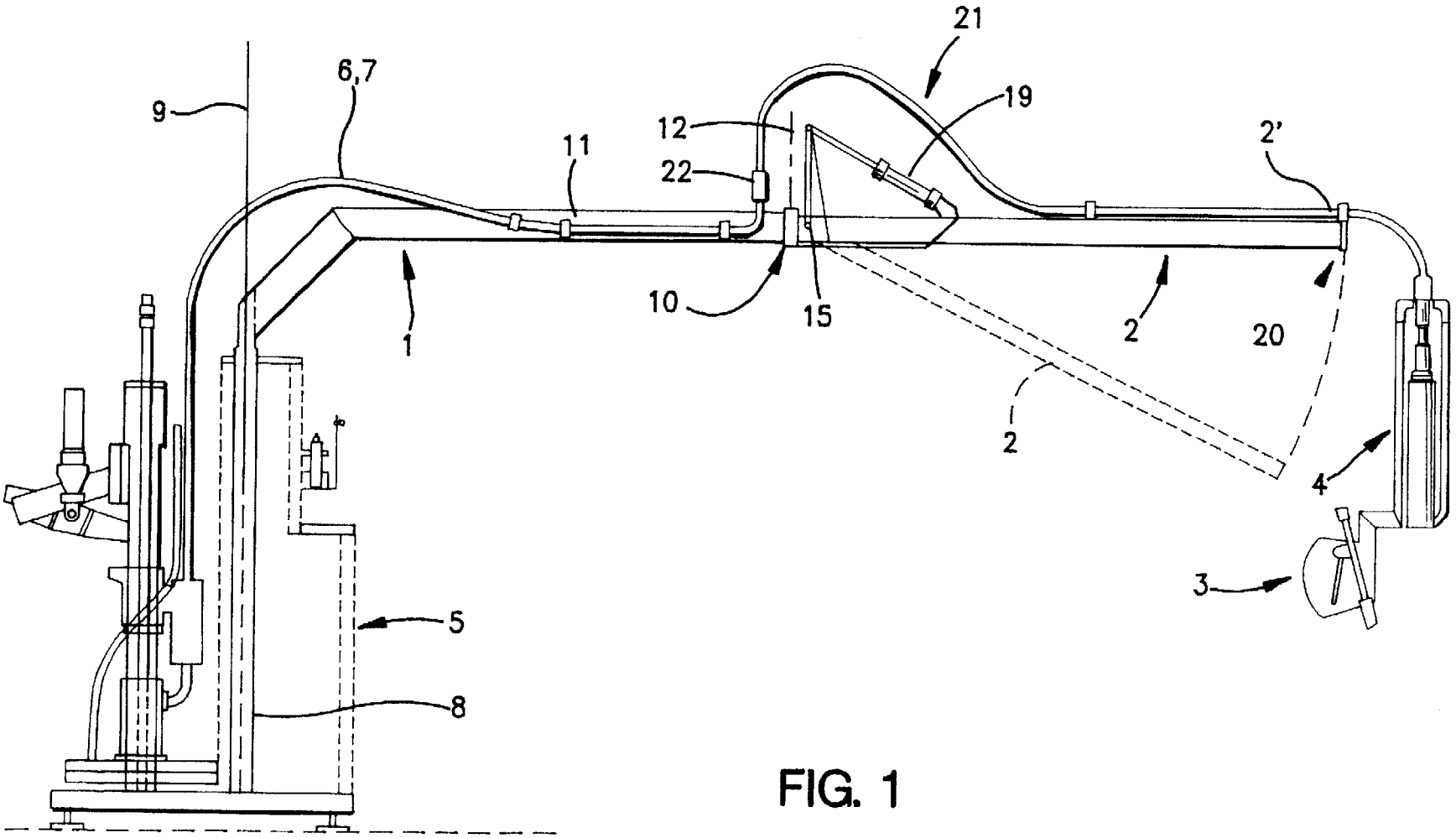
FIG. 1 shows a manual sealing device in general view.

The device according to the invention consists of a bracket 1, a boom 2 with a free end 2', a manual sealing nozzle 3 with mixing device 4 and a supply station 5 for the components of sealing compound. The type of supply station 5 is not important to the invention instead of the embodiment of a supply station 5 for the components of the sealing compound with barrels and barrel pumps depicted in FIG. 1, for example, a supply station with containers of the design known from U.S. Pat. No. 5,535,791 (so-called "big bags") can also be provided. Between supply station 5 for the components of the sealing compound and mixing device 4, which is associated with sealing nozzle 3, lines 6 and 7 are provided through which the components of the sealing compound are fed to mixing device 4 (in the drawing, only one line is visible).

Bracket 1 can be pivoted in the area of supply unit 5 relative to a stand 8 around a vertical axis 9 by, e.g., 220° of swinging.

Boom 2 is fastened to free end 10 of horizontal segment 11 of bracket 1.

Figure 2:
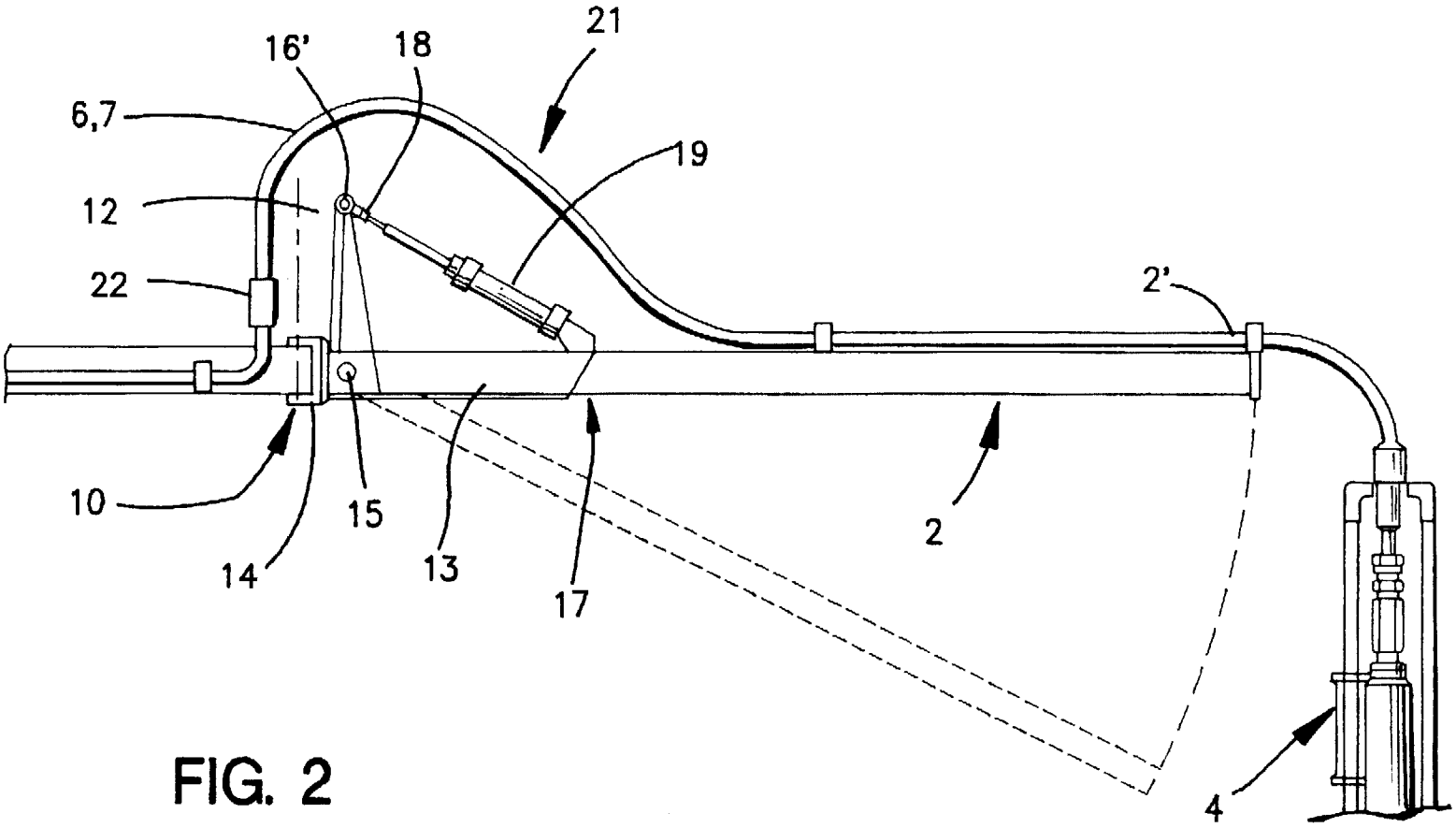
FIG. 2 shows an enlarged detail of it.

Details of the fastening of the boom are evident from FIG. 2 and are described by means of the same:

A support 13 is provided to pivot around a vertical axis 12 at free end 10 of horizontal segment 11 of bracket 1. Support 13 has a cross-sectional shape that resembles a downward-opening U-shape, i.e., the flange of the U-profile of support 13 points upward and is arranged over the end of boom 2 that is accommodated inside support 13. The end of support 13 on the bracket side is connected to a U-shaped yoke 14, whose legs at free end 10 of segment 11 of bracket 1 are mounted in such a way as to pivot around axis 12.

Boom 2 can pivot in support 13 around an axis 15, which is aligned basically horizontally, between the basically horizontal position shown in FIG. 2 and a position pointing downward (in broken lines in FIG. 2).

An arm 16 having a free end 16' is rigidly connected to boom 2. Arm 16 projects upward through an opening provided in the flange of support 13 that points upward. A pneumatic cylinder 19, which acts as a spring in the example, is clamped between end 17 of support 13 and upper end 18 of arm 16.

By selecting the magnitude of the pressure with which pneumatic cylinder 19 is fed and thus the magnitude of the force that exerts an upward action on boom 2 in order to allow movement of sealing nozzle 3, on the one hand, the pivoting position of boom 2 around horizontal axis 15 can be determined, and the combination of sealing nozzle 3 and mixing device 4 can be made to impose virtually no weight on the operator.

A switch 20, which controls the pressurization of pneumatic cylinder 19, is provided at the free end of boom 2, and the possibility exists to feed pneumatic cylinder 19 by actuating switch 20 so that it holds boom 2 in the position that is pivoted all the way up, shown in FIG. 1, and/or boom 2 in the completely lowered position (drawn in broken lines in FIG. 1). The latter position is used if, for example, mixing device 4 and sealing nozzle 3 are put into a deep-cooling vessel (−25° C.) during breaks in operation to keep the sealing compound from hardening in sealing nozzle 3.

Lines 6 and 7 are deflected upward in the area of the hinged connection (6',7') between free end 10 of horizontal segment 11 of bracket 1 and boom 2 in bending are 21. To ensure that boom 2 is able to rotate relative to bracket 1 (axis 12), rotating joints 22 are provided in lines 6 and 7. Because of rotating joints 22 in combination with curve 21, the movements of boom 2 (pivoting around axis 12 by up to 270° and pivoting up and down around axis 15) are not hampered.

In addition to designing pneumatic cylinder 19 as a simple spring, a design is also conceivable in which an amount of pressure medium that corresponds to the respectively desired height adjustment of sealing nozzle 3 (= pivoting position of boom 2 around axis 15) is fed to a piston-cylinder unit that is incorporated instead of pneumatic cylinder 19. If sealing nozzle 3 is pulled down by the operator (e.g., to begin sealing) or raised up (after sealing), the amount of pressure medium is changed (i.e., fed or drawn off) until the motion is stopped by the operator. Also, sealing nozzle 3 (including mixing device 4) is "weightless" in every position.

In summary, the invention, for example, can be represented as follows:

A manual sealing unit consists of a crane-like bracket 1 which is arranged so as to rotate around a vertical axis 9. A boom 2 is connected to pivot around a vertical axis 12 and around a horizontal axis 15 at free end 10 of horizontal segment 11 of bracket 1. Supply lines 6, 7, through which the components of the sealing compound are conveyed to a mixing device 4 and a manual sealing nozzle 3 that is connected to the latter, are fastened to bracket 1 and boom 2. In the area of the joint between bracket 1 and boom 2, lines 6 and 7 are laid in bends 21 and have a rotating joint 22 there, so that the movability of boom 2 is not hampered. Boom 2 is loaded upward by a pneumatic spring 19, so that the combination of mixing device 4 and sealing nozzle 3 for an operator executing the manual sealing is virtually weightless.

What is claimed is:

1. In a device for filling the edge seams of insulating glass panes with sealing compound, comprising a sealing nozzle (3) that is adapted to be moved by hand along (19) acting between the boom (2) and the bracket (1) for to inject sealing compound into the edge seam, a support for said sealing nozzle (3), and conduits (6,7) leading into the nozzle for supplying components of the sealing compound; the improvement wherein the support comprises a first bracket (1) rotatable by swinging around a first vertical axis (9), the bracket being horizontally elongated and at a segment having a free end (10) carrying a horizontally elongated boom (2) having a free end (2') which carries said sealing nozzle (3), means (13, 14) for mounting the boom (2) on said free end (10) of said bracket for pivotal movement both around a second vertical axis (12) and around a horizontal axis (15), and means free end (10) of horizontal segment (11) of urging the boom (2) upward in order to balance the weight of the boom (2) and sealing nozzle (3).

2. Device according to claim 1, wherein an upright arm (16) having a free end (16') is rigidly attached to the boom (2), and said boom urging means (19) acting between said free end of the arm (16) and the boom mounting means (13, 14) to urge the boom upward.

3. Device according to claim 2, wherein said arm (16) projects upward through an opening that is provided in said boom support means (13,14) that is secured to the boom (2).

4. Device according to claim 1, wherein said means (19) urging the boom (2) is a pneumatic cylinder (19).

5. Device according to claim 1, wherein said conduits (6,7) for supplying components of the sealing compound to the sealing nozzle (3) are positioned and arranged in an area of hinged connection (6',7') between the free end (10) of horizontal segment (11) of bracket (1) and the boom (2) are deflected upward in an arc in a bending area (21).

6. Device according to claim 5, wherein a rotating joint (22) is provided in the bending area (21) in each of said conduits (6, 7).

7. Device according to claim 6, wherein said rotating joints (22) are provided in the bending area (21) of said conduits (6, 7) that lead upward from said bracket (1).

8. Device according to claim 1, wherein said bracket (1) and boom (2) are of about the same length.

9. Device according to claim 1, wherein said sealing nozzle (3) is suspended solely by said conduits (6, 7) at said free end (2') of said boom (2).

* * * * *